US007665547B2

(12) United States Patent
Yong et al.

(10) Patent No.: US 7,665,547 B2
(45) Date of Patent: Feb. 23, 2010

(54) DRILL BIT RESERVOIR WITH CONTROLLABLE RELIEF PRESSURE

(75) Inventors: Zhou Yong, Spring, TX (US); George B. Witman, IV, Fort Worth, TX (US); Carlos Torres, Houston, TX (US)

(73) Assignee: Smith International, Inc., Houston, TX (US)

( * ) Notice: Subject to any disclaimer, the term of this patent is extended or adjusted under 35 U.S.C. 154(b) by 243 days.

(21) Appl. No.: 11/601,029

(22) Filed: Nov. 17, 2006

(65) Prior Publication Data

US 2008/0105467 A1 May 8, 2008

Related U.S. Application Data

(60) Provisional application No. 60/737,597, filed on Nov. 17, 2005.

(51) Int. Cl.
*E21B 10/24* (2006.01)

(52) U.S. Cl. ..... 175/228

(58) Field of Classification Search ..... 175/227, 175/228

See application file for complete search history.

(56) References Cited

U.S. PATENT DOCUMENTS

| | | | | |
|---|---|---|---|---|
| 2,906,504 | A * | 9/1959 | Parks | 175/228 |
| 4,154,312 | A * | 5/1979 | Barnetche | 175/228 |
| 4,161,223 | A | 7/1979 | Oelke | |
| 4,388,984 | A | 6/1983 | Oelke | |
| 4,512,669 | A | 4/1985 | Moore | |
| 4,577,705 | A * | 3/1986 | Cross | 175/228 |
| 4,593,775 | A | 6/1986 | Chaney et al. | |
| 4,865,136 | A * | 9/1989 | White | 175/227 |
| 5,072,795 | A | 12/1991 | Delgado et al. | |
| 5,490,570 | A | 2/1996 | Millsapps, Jr. | |
| 5,558,172 | A | 9/1996 | Millsapps, Jr. | |
| 6,619,412 | B2 | 9/2003 | Slaughter, Jr. et al. | |
| 6,802,380 | B2 | 10/2004 | Blackman | |
| 2002/0046884 | A1 | 4/2002 | Page et al. | |

* cited by examiner

*Primary Examiner*—Kenneth Thompson
(74) *Attorney, Agent, or Firm*—Osha • Liang LLP

(57) ABSTRACT

A rotary rock bit includes a lubricant reservoir with a pressure compensation assembly disposed therein. The pressure compensation assembly is adapted to permit selective adjustment of the relief pressure set by the assembly through the selective adjustment of one member in the assembly with respect to another member in the assembly.

18 Claims, 16 Drawing Sheets

DRILL BIT RESERVOIR WITH CONTROLLABLE RELIEF PRESSURE

This application claims the benefit, pursuant to 35 U.S.C. §119(e). of U.S. Provisional Application No. 60/737,597, filed on Nov. 17, 2005.

FIELD OF THE INVENTION

The present invention relates to rock bits and, more particularly, to rock bits with lubricant reservoir systems that include pressure relief.

BACKGROUND ART

Rock bits typically include a bit body adapted to connect to a drill string at one end with one or more legs integrally connected to form the bit body extending from the other end. Each leg typically includes a rolling cutter rotatably mounted on a journal pin extending from each leg. Bearings are typically provided between each rolling cutter and journal pin to promote rotation of the cutter on the journal pin when the bit is rotated on earth formation. Cutting elements provided on the outer surface of each cutter engage and break up earth formation as the bit is rotated.

Rock bits typically further include a lubricant reservoir system for providing lubricant to the bearings to reduce friction and the operating temperature of the bearings and, thereby, increase bearing performance and bearing life. A lubricant reservoir system typically includes a reservoir in the bit body filled with a lubricant and passages provided therein to permit communication of lubricant from the reservoir to the bearings. One or more annular seals are typically provided at or near the back-face of each rolling cutter between the rolling cutter and the journal pin to prevent lubricant from leaking from the bearing area to an exterior of the rock bit. The seals also function to prevent drilling fluid and debris from entering into the bearing area and damaging the bearings.

The durability and effective drilling life of a rolling cutter rock bit depends on numerous factors. One important factor is the effectiveness of the seals used to protect the bearings. Rock bit seals must function for substantial periods of time in harsh downhole conditions involving high pressure, high temperature, and large amounts of abrasive rock particles entrained in the drilling fluid flowing past the seals. In particular, the temperature around the bearing area can become very high due to excessive heat from friction between bearing surfaces, fracturing of rock by cutting, and geothermal conditions underground.

To enhance seal function and increase seal & bearing life, a balance between the internal and external pressures on a seal should be maintained. For example, when a bit is inserted and moved downhole, the pressure on the outside of the bit will increase due to an increase in the fluid column above the bit and higher pressure conditions downhole. Without pressure compensation, pressure on the drilling fluid side of the seal can become substantially higher than the pressure on the lubricant side of the seal, and particulates from the drilling fluid may be pushed into or past the dynamic face of the seal and lead to a rapid destruction of the seal and bearing system. Additionally, during drilling as the temperature around the bearings increases, lubricant in the bit will thermally expand. Without appropriate pressure compensation, including pressure relief, the pressure on the lubricant side of the seal may become excessive and result in an excessive loss of lubricant pass the seal and premature failure of the seal and bearing system.

To avoid such problems and increase seal and bearing life, lubricant reservoir systems typically include a pressure compensation assembly comprising a pressure compensator in the form of a resilient diaphragm positioned in the lubricant reservoir with one side in fluid communication with lubricant in the bit and the other side in fluid communication with drilling fluid outside of the bit. The compensator functions to equalize the pressure of the lubricant in the bit with the drilling fluid outside of the bit so that the differential pressure across the seal during drilling will be minimized. The pressure compensation assembly is typically configured to include a pressure relief structure for the lubricant reservoir system to protect the compensator from exposure to extreme differential pressures that can result due to excessive thermal expansion or overfill in the system. Pressure relief structure typically includes some form of a valve face biased against a valve seat by a bias force provided by a bias member. The pressure relief structure is arranged such that when excessive lubricant pressure occurs in the reservoir system the bias force will be overcome and the valve face will be displace from the valve seat to permit lubricant to vent there between until the pressure differential is reduced to an acceptable level.

In conventional reservoir systems, once a bias member is selected and assembled in the system, the relief pressure of the system is set and cannot be changed. Machining errors and tolerances can cause variation in the relief pressure of a system. As a result, the set pressure at which a particular system will relieve is not know, but rather is considered to fall within a range, such as from 50 to 200 pounds per square inch (psi) depending on the size or dimensions of the bit. Thus, lubricant reservoir systems in different bits or different legs of a bit may be exposed to different maximum pressures during drilling, which can lead to an earlier failure in one of the systems. Additionally, if a different relief pressure is desired for a system, the system will have to be disassembled and different parts introduced or redesigned. This can increase bit manufacturing cost significantly. Accordingly, a pressure compensation assembly having an adjustable relief pressure is desired so that the relief pressure of a system can be changed or adjusted without requiring redesign or the use of different parts in the system.

DETAILED DESCRIPTION

Figure 1:
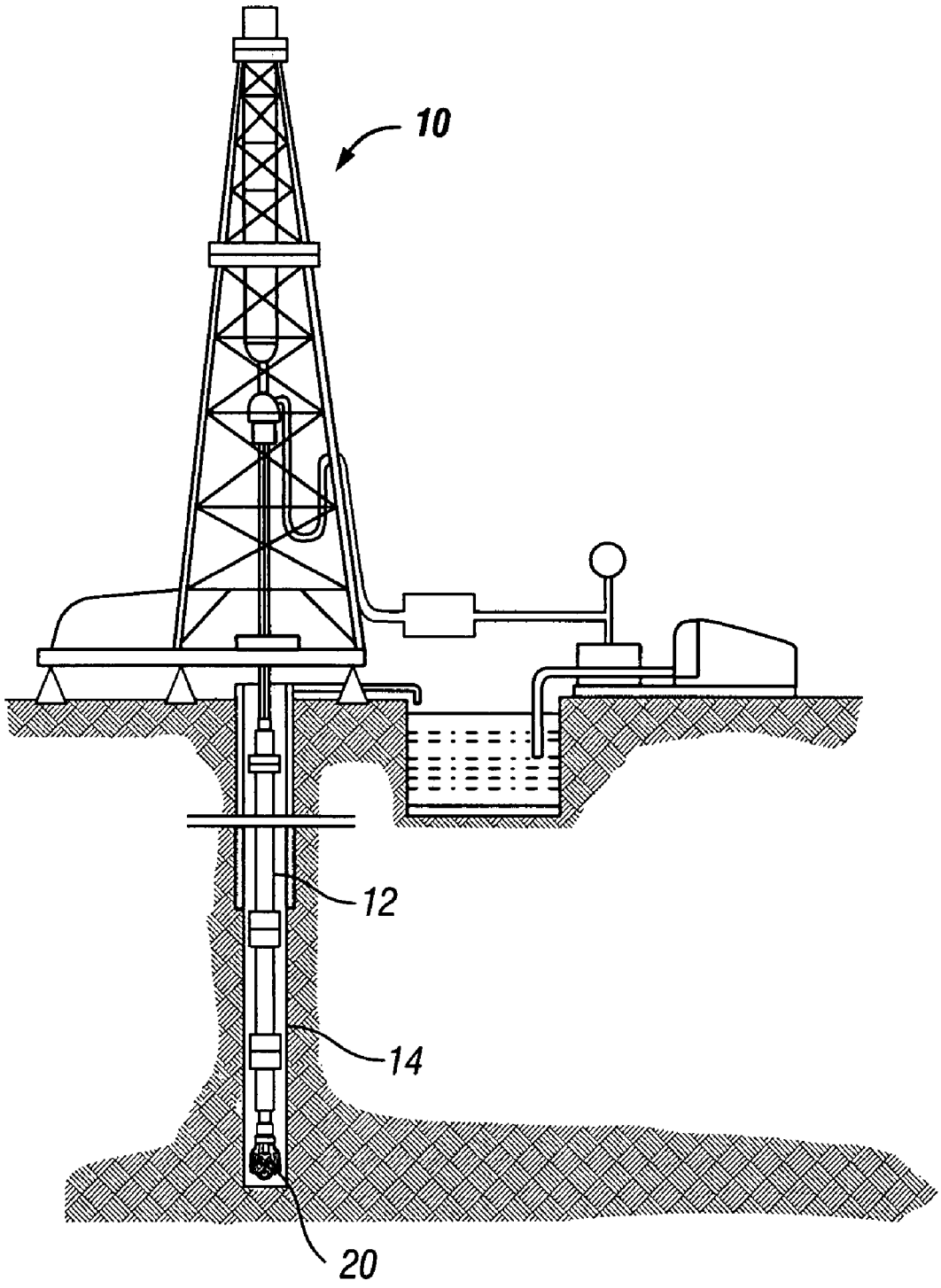
FIG. 1 (Prior Art)
FIG. 1 shows a drilling system.

The present invention relates to rock bits with lubricant reservoir systems that include pressure relief to keep pressure differentials across the dynamic rotary seal within a predetermined operating range. In accordance with embodiments of the present invention, a pressure relief structure provided in a lubricant reservoir system is adapted such that the relief pressure of the system can be selectively changed or adjusted.

Example embodiments of the invention will be described below with reference to the accompanying figures. Similar elements in the various figures are denoted with like reference numerals for simplicity. Although numerous specific details are set forth for example embodiments of the invention described herein to provide a thorough understanding of aspects of the invention, it will be apparent to one of ordinary skill in the art that the invention may be practiced without these specific details. In other instances, well-known features may not have been described in detail to avoid obscuring the invention.

Now referring to the figures, one example of a drilling system used in the oil and gas industry for drilling boreholes through earth formations is shown in FIG. 1. The drilling system includes a drilling rig 10 used to turn a drill string 12 which extends into a well bore 14. Connected to the end of the drill string 12 is a rolling cutter rock bit 20.

Figure 2:
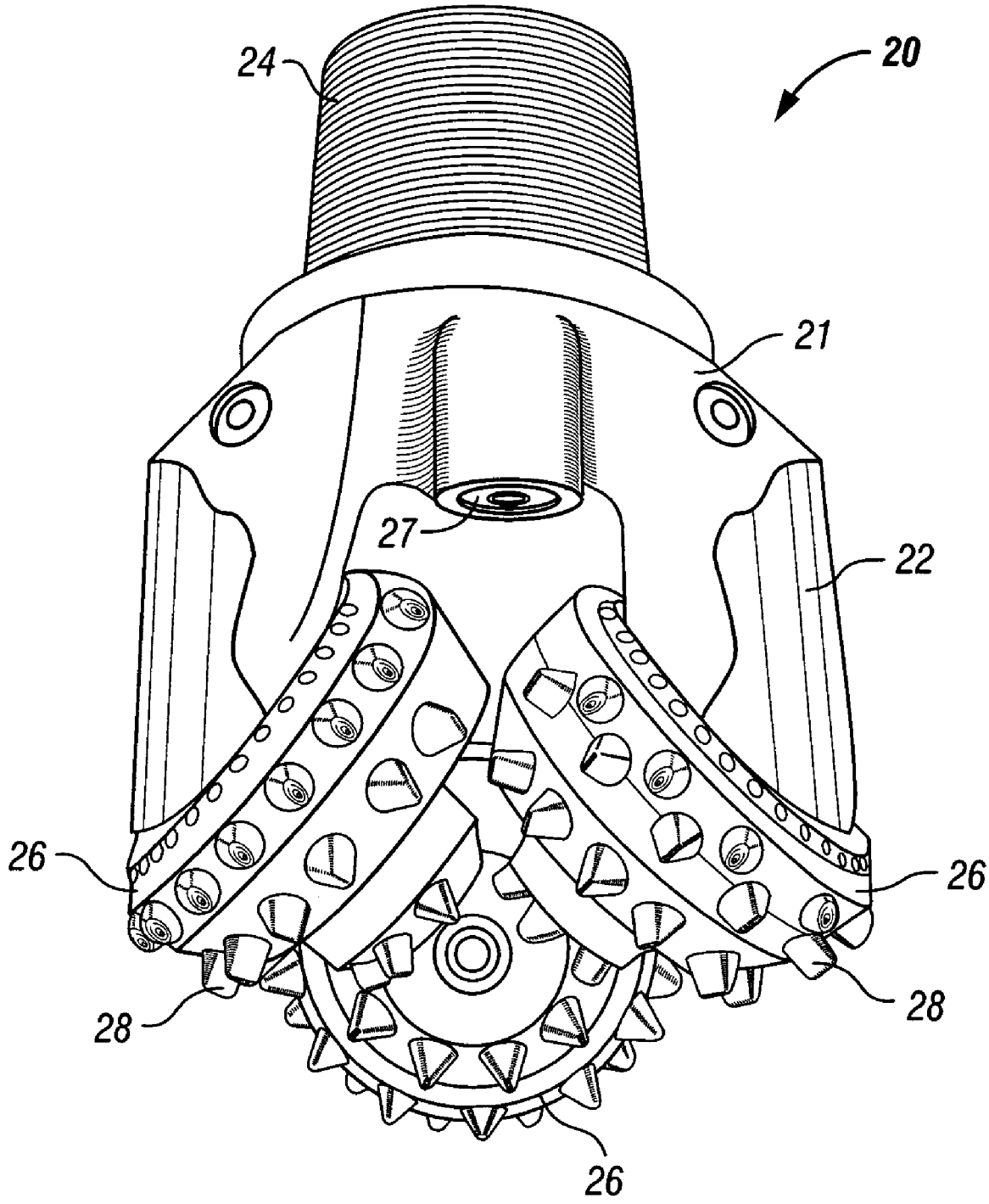
FIG. 2 shows an isometric view of a rotary cone drill bit.

One example of a rolling cutter rock bit is shown in FIG. 2. Although the example shown is a roller cone bit having three rolling cones, those skilled in the art will appreciate that aspects of the present invention described below are applicable to any type of drill bit having a lubricant reservoir system, such as any type of bit with one or more rolling cutters, including roller cone bits and disc bits.

Referring to the example in FIG. 2, the rock bit 20, includes a bit body 21 having a threaded connection 24 at one end for connecting to a drill string and a plurality of legs 22 extending downwardly at the other end. A journal pin (not shown) is formed at the lower end of each of the legs 22. A roller cone 26 is rotatably mounted on each journal pin of a respective leg 22. Each roller cone 26 includes cutting elements 28 extending from an outer surface thereof and adapted to break up formation when the bit is rotated under an applied force on earth formation. The cutting elements 28 on the cones 26 may comprise tungsten carbide inserts, milled steel teeth, diamond enhanced inserts, or any other type or combination of cutting elements known in the art. The rock bit 20 further includes a central passageway (not shown) that extends along a central axis (not shown) into the bit body 21 and nozzles (or fluid ports) 27 in communication with the central passage to allow drilling fluid to pass through the bit body and out of nozzles 27 of the bit 20. During drilling, drilling fluid pumped through the bit and out of the nozzles 27 washes past the cutting elements 28 and bottom of the well bore to carrying away cuttings and debris generated during drilling. The drilling fluid is then forced up the annulus between the drill string and the wall of the well bore to carry the cuttings and debris to the earth surface.

Figure 3:
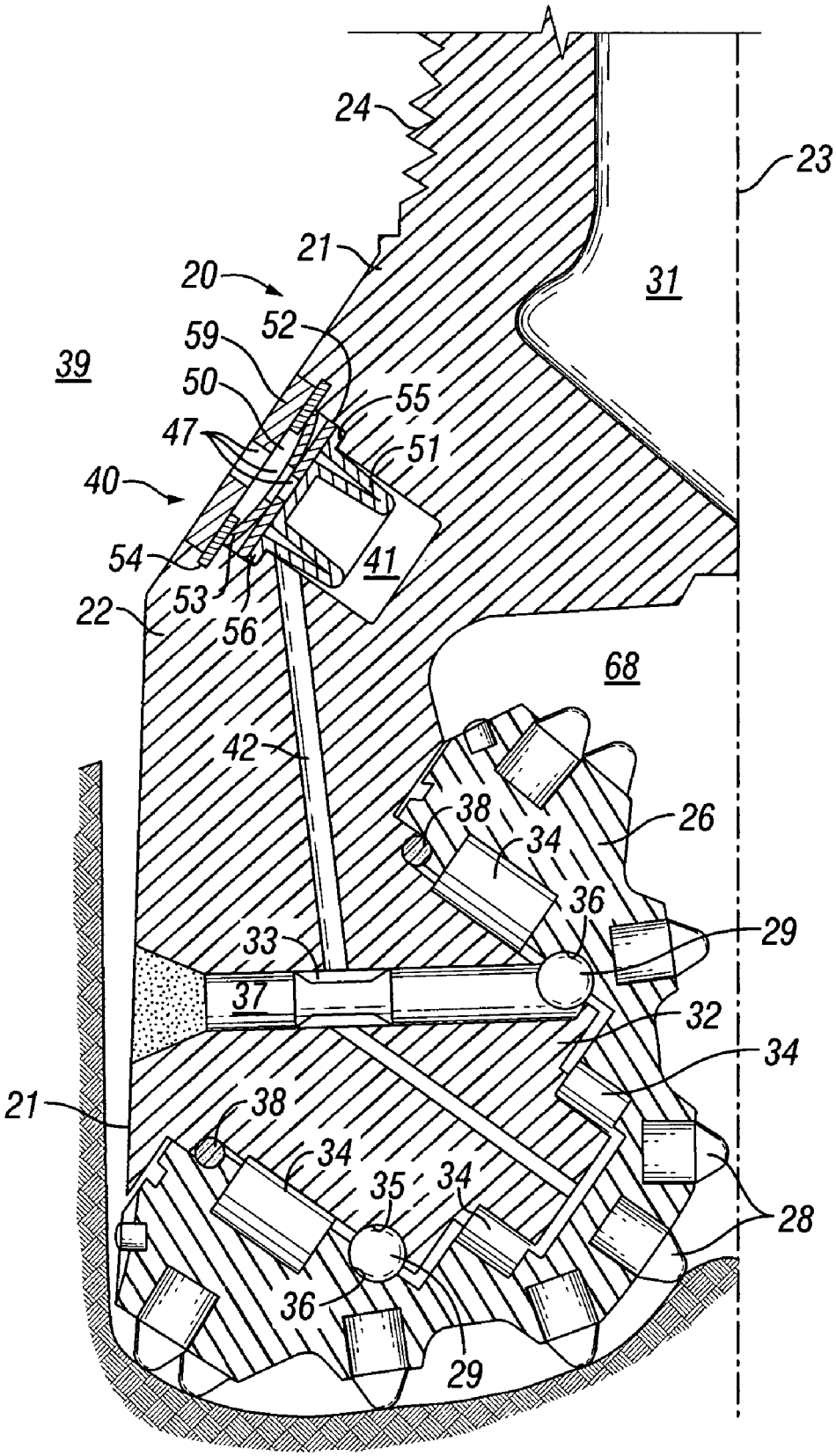
FIG. 3 shows a cross-sectional view of one leg of a rotary cone drill bit having a lubricant reservoir system with a pressure compensation assembly disposed therein.

One example of an interior structure of a leg 22 of a known rock bit 20 is shown in FIG. 3. The roller cone 26 is mounted on the journal pin 32 of the leg 22. The journal pin, which extends inwardly and downward, engages with bearing surfaces formed in the roller cone 26. The bearing surfaces of the journal pin 32 and cone 26 include corresponding circumferential grooves 35 and 36 configured to receive a plurality of balls 29 there between which lock the cone 26 in place on the journal pin 32. A ball passageway 33 extending through the journal pin 32 and intersecting the groove 35 forms a means by which the locking balls 29 are placed between the cone 26 and journal pin 32 during assembly. After the balls 29 are in place, a ball retainer 37 is inserted in the ball passageway 33 and an end plug is welded or otherwise secured in the opening to close off the ball passageway 33. Bearings 34 are provided between the journal pin 32 and the roller cone 26 to facilitate rotation of the cone 26 on the journal pin 32 during drilling.

Lubricant, such as grease (not shown), is provided to the bearings 34 via a lubricant reservoir system 40. The lubricant reservoir system 40 includes a lubricant reservoir 41 in fluid communication with the bearings of the leg 22 via a lubricant passageway 42 that connects to the ball passageway 33 extending into the journal pin 32. Lubricant provided to the bearings 34 is retained around the bearings 34 by one or more annular seals 38 disposed between the cone 26 and journal pin 32 near the back-face of the cone 26. Seal 38 also prevents drilled cuttings and abrasive drilling fluid from passing to the bearings 34, washing out the lubricant, and damaging the bearing surfaces.

A pressure compensation assembly is also disposed in the reservoir 41 and adapted to equalize internal and external reservoir pressures to minimize pressure differentials across the seal 38. The pressure compensation assembly includes a resilient diaphragm 50 positioned in the reservoir 41 such that one side (a "lubricant side") is in fluid communication with lubricant supplied to the bearings 34 and on the other side (a "drilling fluid side") is in communication with fluid from outside 39 of the bit. The diaphragm 50 is deformable in response to a pressure differential there across and may also be configured to provide a small positive pressure differential on the lubricant side to promote lubricant flow to the bearings 34.

In the example shown, the diaphragm 50 will be referred to as a "reservoir boot" 51 and includes a contoured geometry which can be generally described as somewhat cup-like in form with a radially extending flange 56 around an upper end and having a bottom surface that protrudes back up into the cup to form an inverted cup at the other end with folded sidewalls there between. The reservoir boot 51 is formed of a resilient material, such as rubber or the like, which may be molded around stiffener material, such as metal or the like. This is only one example of a reservoir diaphragm structure that may be used in an assembly. Numerous other diaphragm structures, assembly arrangements, and reservoir system configurations exist and may alternatively be used. For example see U.S. Pat. Nos. 4,161,223, 4,865,136, 5,072,795, and 6,619,412, incorporated herein by reference.

Referring to the example shown in FIG. 3, a side wall of the reservoir 41 is configured to form an annular seat 55 in an upper section thereof to receive and permit sealing with a lower face provided on the flange 56 of the reservoir boot 51 inserted therein. A boot cap 52 is disposed in the reservoir 41 on top of the reservoir boot 51. A bias member in the form of a Belleville spring 53 is disposed on top of the boot cap 52, and a cover cap 59 is disposed on top of the Belleville spring 53. The assembly is retained in the reservoir 41 against the annular seat 55 by a retaining ring 54 engaged with a groove formed in the reservoir wall. A passageway 47 is formed in the boot cap 52, Belleville spring 53 and cover cap 59 to permit communication of fluid outside 39 the drill bit 20 to the outward facing side of the reservoir boot 51. The opposite side of the reservoir boot 51 is in communication with lubricant supplied to the bearings 34 via lubricant passageway 42 and ball passageway 33.

With this arrangement, compression of the Belleville spring 53 between the cover cap 59 and boot cap 52 provides a biased float mounting arrangement of the reservoir boot 51 and cover cap 52 against the reservoir seat 55. As will be further described below, this type of biased float mounting arrangement is used to permit pressure relief for the system. That is, when a maximum reservoir pressure differential is reached in the system, the reservoir boot 51 will be forced against the boot cap 52 and result in a force on the boot cap 52 that overcomes the bias provided by the Belleville spring 53 to permit excess lubricant to vent from the reservoir 41 between the annular seat 55 and flange 56.

A fill hole (not shown) leading to the lubricant reservoir may be used for filling the reservoir system with grease. When a lubricant reservoir system is filled, a vacuum is typically applied to remove air in the system. Then the lubricant is injected in the system under pressure and enclosed therein, such as by a pipe plug or other means used to seal off the injection inlet. For a system including pressure relief, such as the one shown in FIG. 3, the reservoir's pressure relief structure will operate to limit the pressure inside the reservoir to an acceptable level.

Figure 4A:
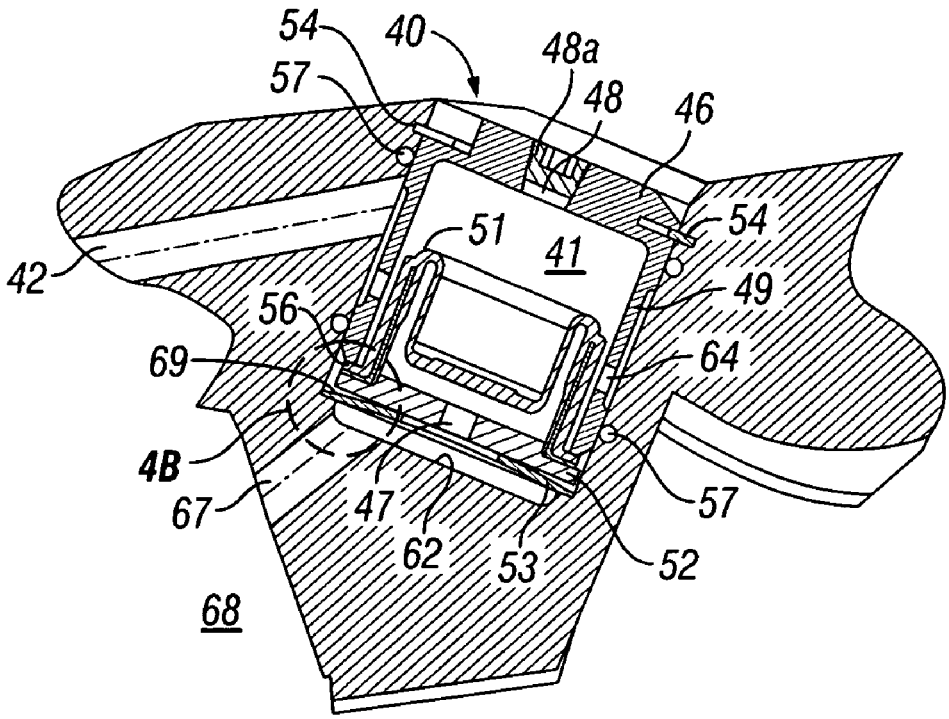
FIG. 4 shows another example of a lubricant reservoir system with a pressure compensation assembly disposed therein.
Figure 4B:
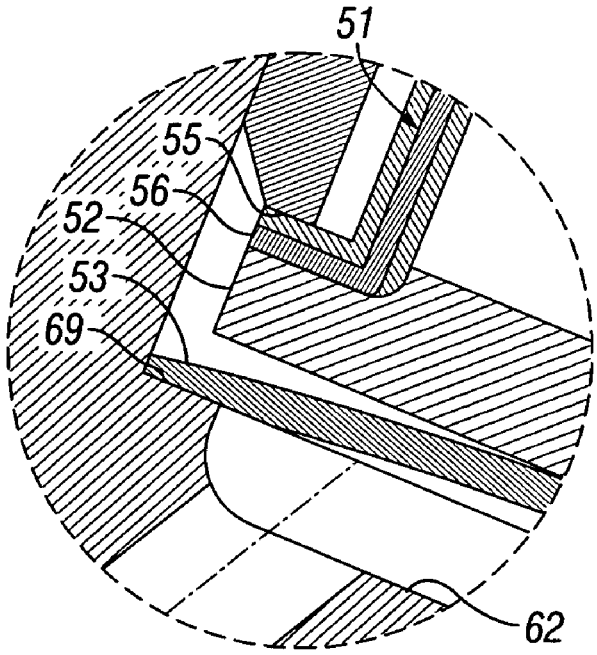

FIG. 4 shows one example of an alternative arrangement for a pressure compensation assembly similar to that shown in FIG. 3. Referring now to FIG. 4, in this example, the reservoir boot 51 is inverted in the reservoir 41 and placed in communication with fluid outside the bit body via a passageway 67 extending from the lower end of the reservoir 41 to a dome area 68 (see 68 in FIG. 3) between the legs of the bit. The reservoir 41 includes a recessed portion 62 at its lower end and an annular seat 69 formed by the wall of the reservoir 41 above the recessed portion 62 to support components of the pressure compensation assembly therein. The pressure compensation assembly disposed in the reservoir 41 includes a bias member in the form of a Belleville spring 53 which is supported on the annular seat 69 in the reservoir 41 with its inner diameter bowed upward towards the outside of the bit. An assembly comprising a reservoir boot 51 with one end extending into a canister 49 and the other end enclosed therein by a boot cap 52 is disposed in the reservoir 41 with the boot cap 52 end positioned adjacent the Belleville spring 53. Holes 64 are provided in the wall of the canister 49 to permit communication from the lubricant side of the reservoir boot 51 to the bearings (not shown) via the lubricant passageway 42. A passageway 47 is provided in the boot cap 52 to permit communication between the lubricant side of the reservoir boot 51 and fluid outside of the bit via passageway 67. O-ring seals 57 are disposed in grooves formed in the wall of the reservoir 41 above and below the inlet to lubricant passageway 42 to seal against the outer surface of the canister 49 and isolate lubricant flow from drilling fluid flow in the reservoir 41. The components of the assembly are retained in the reservoir 41 via retaining ring 54 engaged between a groove in the wall of the reservoir 41 and a corresponding groove around the enclosed outward facing end of the canister 49.

This system is configured such that when the pressure compensation assembly is locked in place in the reservoir 41, the lower face of the flange 56 on the reservoir boot 51 is urged against the annular seat 55 at the opened end of the canister 49 by the Belleville spring 53 compressed between the boot cap 52 and reservoir seat 69. The biasing force on the boot cap 52 due to compression of the Belleville spring 53 forces the face of the flange 56 against the canister seat 55 such that sealing occurs there between. The biased float mounting arrangement of the reservoir flange 56 against the canister seat 55 is provided to permit pressure relief when excess lubricant pressure is generated in the system, such as due to thermal expansion or overfill. With this configuration, pressure relief is achieved when lubricant pressure becomes high enough to force the reservoir boot 51 against the boot cap 52 with a force that overcomes the biasing force of the Belleville spring 53 and unseats the flange 56 of the reservoir boot 51 from the canister seat 55 such that lubricant is allowed to vent there between. Thus, the flange 56 biased against the seat 55 by the Belleville spring 53 provides the biased valve face/valve seat arrangement that functions as the pressure relief structure for the lubricant reservoir system.

Numerous different configurations for lubricant reservoir pressure compensation assemblies exist. For those having a pressure relief structure comprising, in one form or another, a valve face biased against a valve seat by a bias member, the bias provided in the system may vary depending on the bias member selected as well as several factors in the system that determine the compression of the bias member. For the example system shown in FIG. 4, bias pressures of between 50 to 200 pounds per square are typically desired.

As noted in the Background section herein, once a bias member is selected and assembled in a conventional lubricant reservoir system, the relief pressure of the system is fixed by the parts integrated into the system and is not adjustable. Because of inevitable machining tolerances and errors of parts in a system, significant variation of the deformation of the bias member in the system and, thus, the relief pressure can result. Therefore, a specification has to allow for pressure relief of the reservoir system to vary, such as from 50 to 100 psi for small bits or 50 to 200 psi for larger bits. If inaccuracy of the thickness of a Belleville spring is also taken into account, the error may be greater. These undesired large deviations bring about a series of problems to performance of current seals/bearing systems. For example, in the case of a three cone bit a reservoir system provided in each leg, the seals/bearings of the three legs may perform differently due to different relief pressures provided for each leg. This can lead to an early seal failure for one of the legs and premature failure of the bit. In addition, uncertainty of consistency between assemblies gives rise to barriers in evaluating performance of new seals/bearings.

Also, in conventional systems, the relief pressure of a system cannot be changed to fit different requirements of applications unless new parts are introduced into the assembly, which can increase manufacturing cost significantly when different relief pressures are desired in bits for different applications.

Examples of Assemblies with Controllable Relief Pressure

In accordance with the present invention, pressure compensation assemblies having pressure relief structure comprising a face biased against a seat by a bias member can be configured or modified such that a relief pressure of the lubricant reservoir system can be selectively adjusted or changed. In such systems, the deformation of a bias member in the reservoir becomes controllable by providing relative movable parts within the system such that the position of one part can be adjusted relative to another to produce an adjustment in a bias provided by a bias member. Accordingly, embodiments of the present invention include new features that allow reservoir relief pressures to be controllable and more accurately set. As a result, deviations of inaccuracy resulting from unavoidable machining tolerances and errors in systems can be eliminated. Applications of reservoir systems in accordance with aspects of the present invention can be extended to selectively varying or setting the relief pressures for lubricant reservoir systems in rock bits based on parameters such as rock formation properties, drilling depth, operation pressure, drilling speed, bit size, and bit types.

In example embodiments described herein, adjustable relief pressure has been achieved by providing a pair of elements or parts in the lubricant reservoir system that include adjustable threads wherein the two elements are adapted in the system to permit a relative position of the two elements to be changeable through advancement of one against the other. The bias member provided in the system is in contact (directly or indirectly) with one of the two elements such that the biasing force of the bias member is changed when one of the elements relocates through the thread relative to the other. While the following examples have relative adjustable moving parts provided by embedding threads into an assembly element, those skilled in the art will appreciate that other means may alternatively be used. Using a reservoir system in accordance with the present invention, the displacement of adjustable parts may be changed to compensate for errors or tolerance differences due to machining operations. Also, the displacement of relative adjustable parts may be selectively set to a desired value to thereby control the resulting relief pressure for a system.

For a clearer understanding of aspects of the present invention, example embodiments described below are presented in the form of pressure compensation assemblies similar to those described above with reference to FIG. 3 and FIG. 4. From the examples and discussion provided herein, it will be appreciated that similar modifications can be made in other assemblies regardless of their particular configurations to produce pressure compensation assemblies and lubricant reservoir systems with adjustable relief pressures in accordance with the present invention.

Figure 5:
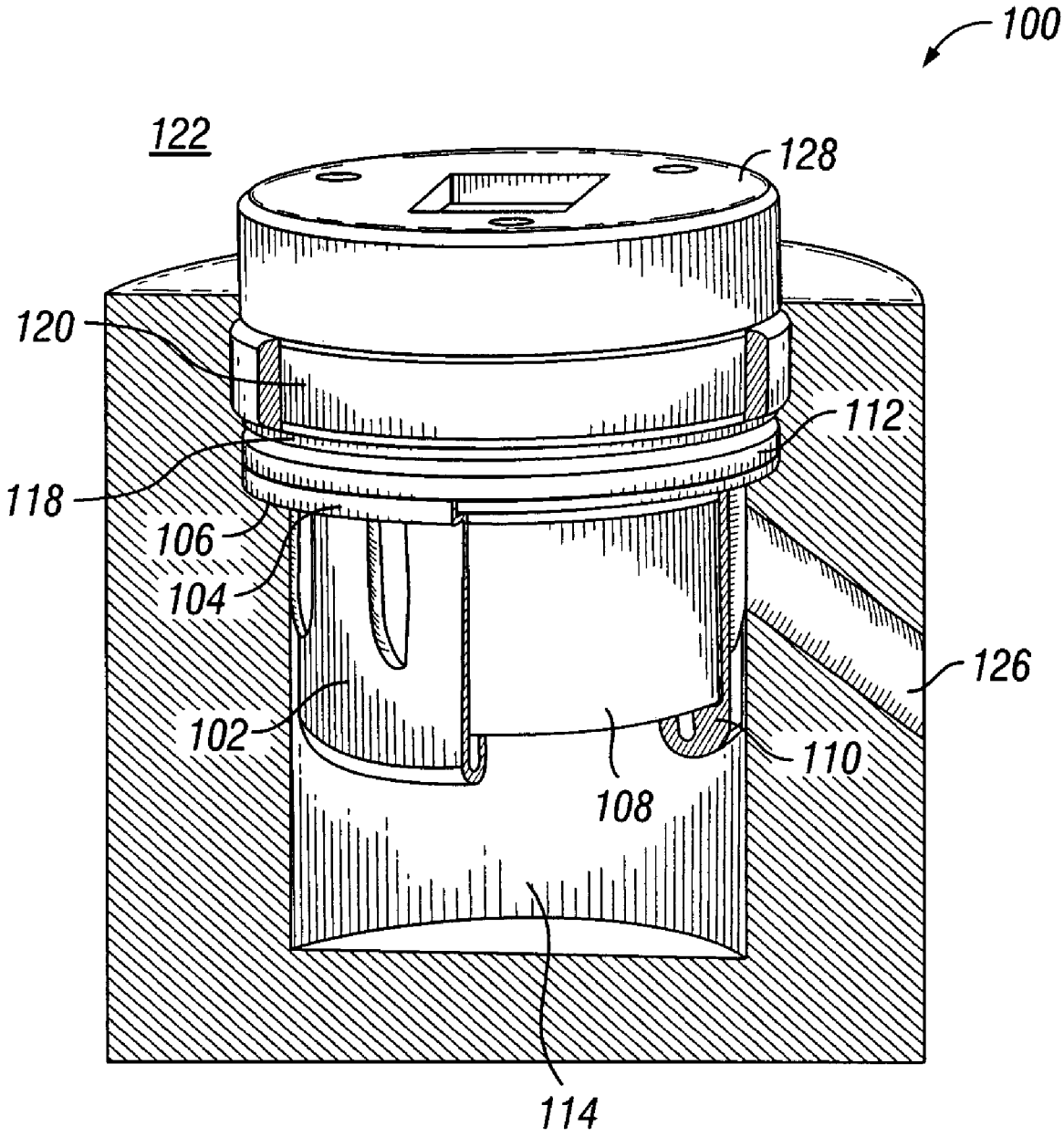
FIG. 5 shows one embodiment of a lubricant reservoir system with a pressure compensation assembly similar to the one shown in FIG. 3, but modified in accordance with aspects of the present invention.

Now referring to a first embodiment of the present invention shown in FIG. 5. This embodiment is configured similar that the example shown and described with reference to FIG. 3; however, in this case the pressure compensation assembly is adapted to permit adjustment of the reservoir relief pressure in accordance with aspects of the present invention. The system 100 includes a reservoir 114 formed in a bit and having a side wall configured to define an annular seat 106 therein which is adapted to receive a lower face of a radially extending annular flange 104 formed around one end of the reservoir boot 102. The reservoir boot 102 is similar to the one shown in FIG. 3, and is formed of a resilient material 108, such as rubber or the like, molded around stiffener material 110, such as metal or the like.

Figure 6A:
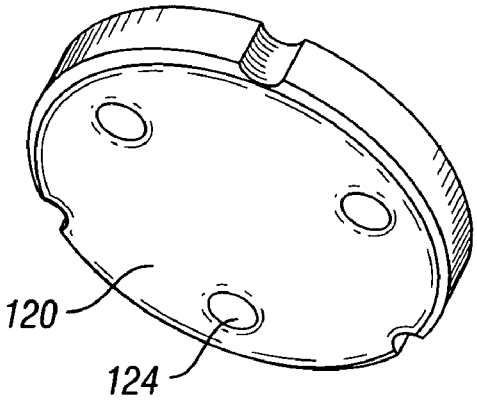
FIGS. 6A-C show perspective, top and side views, respectively of the adjustment member shown in FIG. 5.
Figure 6B:
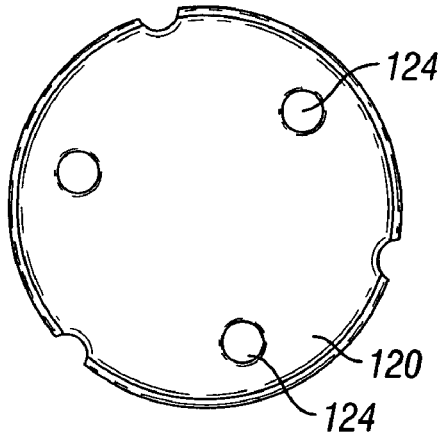
Figure 6C:
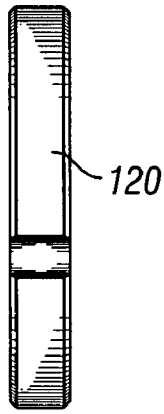

A boot cap 112 formed of a rigid material, such as metal or the like, is disposed over the flanged end of the reservoir boot 102 supported on the reservoir seat 106. The boot cap 112 further includes a passageway (not shown) therein to permit communication of fluid from outside 122 the drill bit to the drilling fluid side of the reservoir boot 102. A bias member in the form of a Belleville spring 118 is supported on the boot cap 112 with its inner diameter bowed upward toward the outside 122 of the bit. An adjustment member 120 is disposed in the reservoir 114 on top of the Belleville spring 112. The adjustment member 120 in this example comprises a disc-shaped member having a selected thickness and an outer radial periphery thereof adapted with threads for mating with threads provided in the reservoir wall along an upper section of the reservoir 114 above the reservoir seat 106. As shown in further detail in FIGS. 6A-6C, the adjustment member 120 further includes passageways 124 formed therein to permit communication of fluid from outside 122 the bit to the drilling fluid side of the reservoir boot 102. The passageways 124 in this example also serve as tool coupling holes to allow for coupling of an adjustment tool so its location in the reservoir 114 can be changed.

The adjustment member 120 engaged with the threads in the reservoir 114 functions to retain the assembly in the reservoir 114. The adjustment member 120 is also positioned in the reservoir against the Belleville spring 118 such that the boot cap 112 and reservoir boot 102 are biased float mounted against the reservoir seat 106 with an biasing force provided by the Belleville spring 118 sandwiched between the boot cap 112 and adjustment member 120. The compression of the Belleville spring 118 provides the spring bias for the pressure relief system which determines the set pressure at which lubricant will vented from the system.

The reservoir boot 102 is arranged in the reservoir 114 in a manner similar to that shown in FIG. 3, such that when the system 100 is filled with lubricant (not shown) one side of the reservoir boot 102 is placed in fluid communication with lubricant supplied to the bearings via a lubricant passageway 126, and the other side of the reservoir boot 102 is placed in fluid communication with fluid outside 122 the drill bit via passageways in the boot cap 112, Belleville spring 118, and adjustment member 120. As is known in the art, a fill passage (not shown) leading to the lubricant reservoir 41 is provided in the bit body to allow filling of the lubricant reservoir 41 and thereafter is sealed.

During operation of the bit, when the pressure outside of the bit increases beyond the lubricant pressure, the reservoir boot 102 will deform to compress the lubricant in the reservoir until lubricant pressure and drilling fluid pressure are sufficiently balanced. Similarly, when the lubricant pressure in the bit increases beyond the drilling fluid pressure, the reservoir boot 102 will deform to expand the lubricant volume such that contact may be made between the reservoir boot 102 and end cap 112. Since the end cap 112 is in contact with the Belleville spring 118, the load from the reservoir boot 102 will transfer to the Belleville spring 118. When this transferred load exceeds the Belleville spring force, the lower face of a flange 104 of the reservoir boot 102 will disengage from the reservoir seat and permit lubricant to vent from the system 100 there between until the transfer force resulting from the pressure differential falls below the spring force provided by the Belleville spring 118.

Figure 7A:
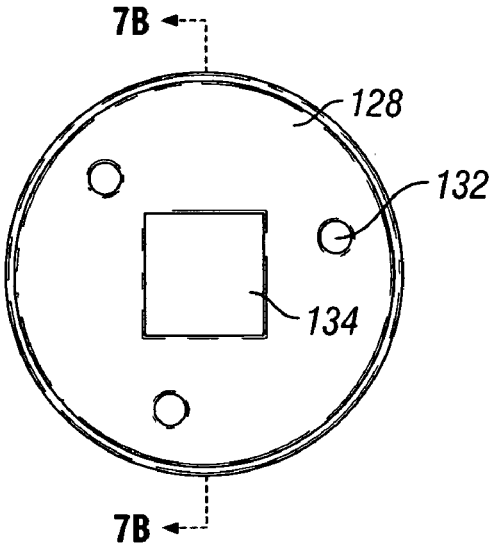
FIGS. 7A-B show top and side views, respectively, of the tool connector shown in FIG. 5.
Figure 7B:
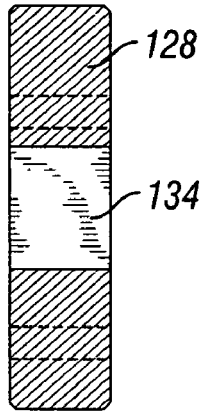

As shown in FIG. 5, a removable tool connector 128 may be used to couple an adjustment tool (not shown), such as a wrench, to adjustment member 120 to permit selectively adjustment of its location in the system and, thereby, adjust the compression and resulting bias force provided by the Belleville spring 118. As shown in further detail in FIGS. 7A-7B, in this embodiment the tool connector 128 is adapted to couple to the adjustment member 120 by aligning holes 132 in the connector 128 with the passageways 124 in the adjustment member 120 and inserting pins or the like (not shown) such that a torque applied to the tool connector 128 will be transferred to the adjustment member 120. The pins (not shown), if desired, may be welded or otherwise fixed in the holes 132 of the tool connector 128 such that they extend there from for simplified alignment and coupling of the connector 128 with the attachment member 120. Alternatively, the pins (not shown) may be provided as extensions from an adjustment tool (not shown). After a desired adjustment has been made to the system to produce the desired bias force provided by the Belleville spring 118, the tool connector 128 can be removed and the adjustment member may be prevented from further movement, if desired, by fixedly attaching it to the reservoir, such as by welding or other mechanical means.

Figure 8:
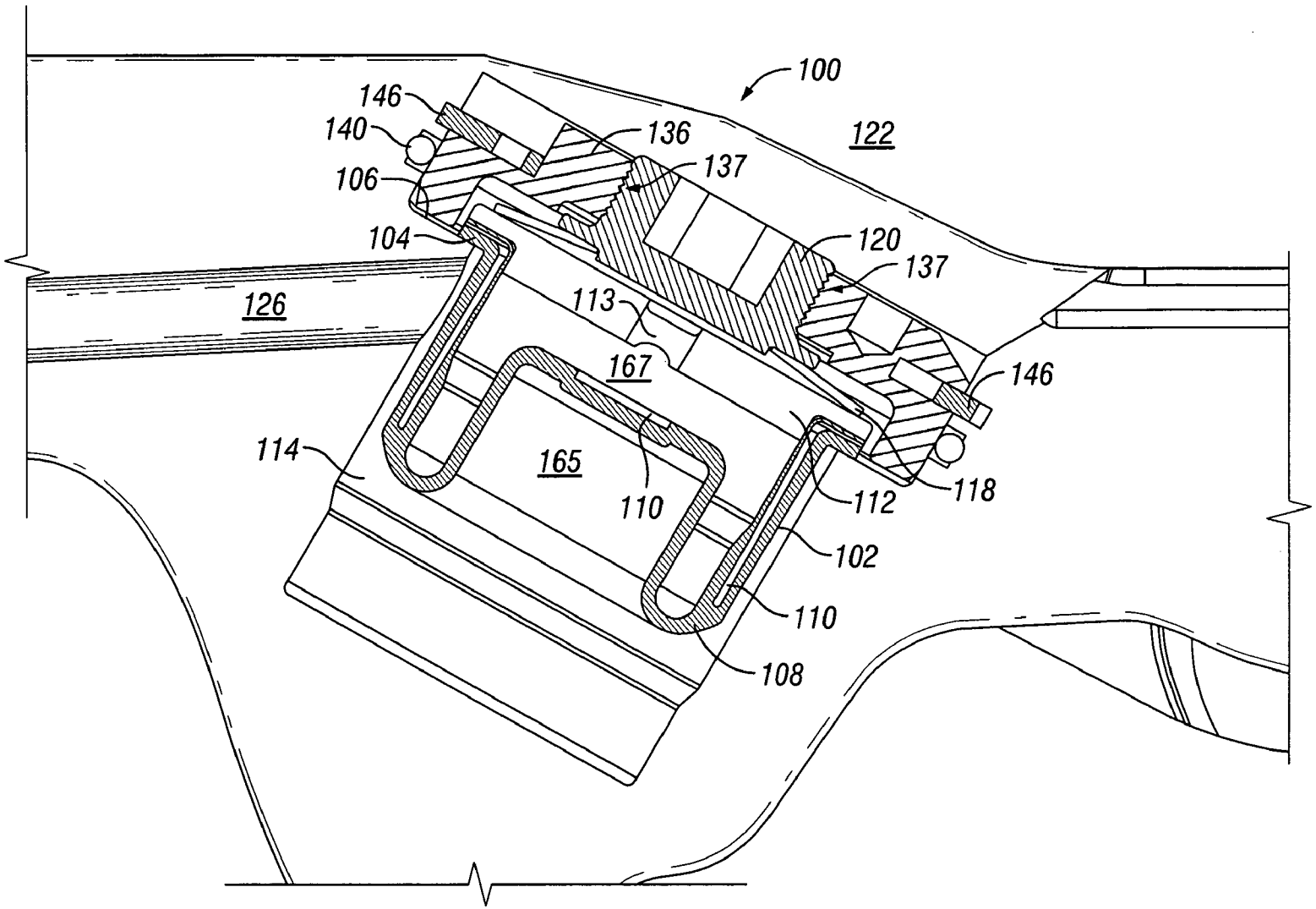
FIG. 8 shows another embodiment of a lubricant reservoir system in accordance with aspects of the present invention.

FIG. 8 shows another arrangement for a reservoir system similar to that shown in FIG. 5. As described above, the system 100 includes a reservoir boot 102 formed of resilient material 108 molded around stiffener material 110 and suspended in the reservoir 114 via a boot flange 104 seated against an annular seat 106 in the wall of the reservoir 114. A boot cap 112 is disposed over the flanged end of the reservoir boot 102 and includes a passageway 113 therein to permit communication of fluid from outside 122 the drill bit to the drilling fluid side 167 of the reservoir boot 102. The opposite side (lubricant side 165) of the reservoir boot 102 is placed in fluid communication with bearings (not shown) via lubricant passageway 126, A Belleville spring 118 is supported on the boot cap 112 with its inner diameter bowed upward toward the outside 122 of the bit.

In this embodiment, however, rather than providing threads in the wall of the reservoir for coupling with an adjustment member, the reservoir system 100 includes a two part cover cap comprising a stationary cap 136 and an adjustment member 120. The stationary cap 136 is fixed in the reservoir 114 by a retaining ring 146 or similar means and generally functions to retain the assembly components therein. The adjustment member 120 is coupled to the stationary cap 136 via mating threads 137 provided along an interior diameter of the stationary cap 136 and an exterior surface along an upper portion of the adjustment member 120. The adjustment member 120 is engaged with the stationary cap 136 with a lower face disposed in contact (directly or indirectly) with an upper surface of the Belleville spring 118 and an upper portion threaded into the stationary cap. The upper end is accessible on an outside of the reservoir 114 with a nut-like recess geometry formed therein such that a wrench or similar tool can be engaged therein and used to rotate the adjustment member 120 relative to the stationary cap 136. This design allows for the adjustment of the relief pressure for the system by rotating the adjustment member 120 by a selected amount in order to compression the Belleville spring 118 a certain deflection.

Figure 14:
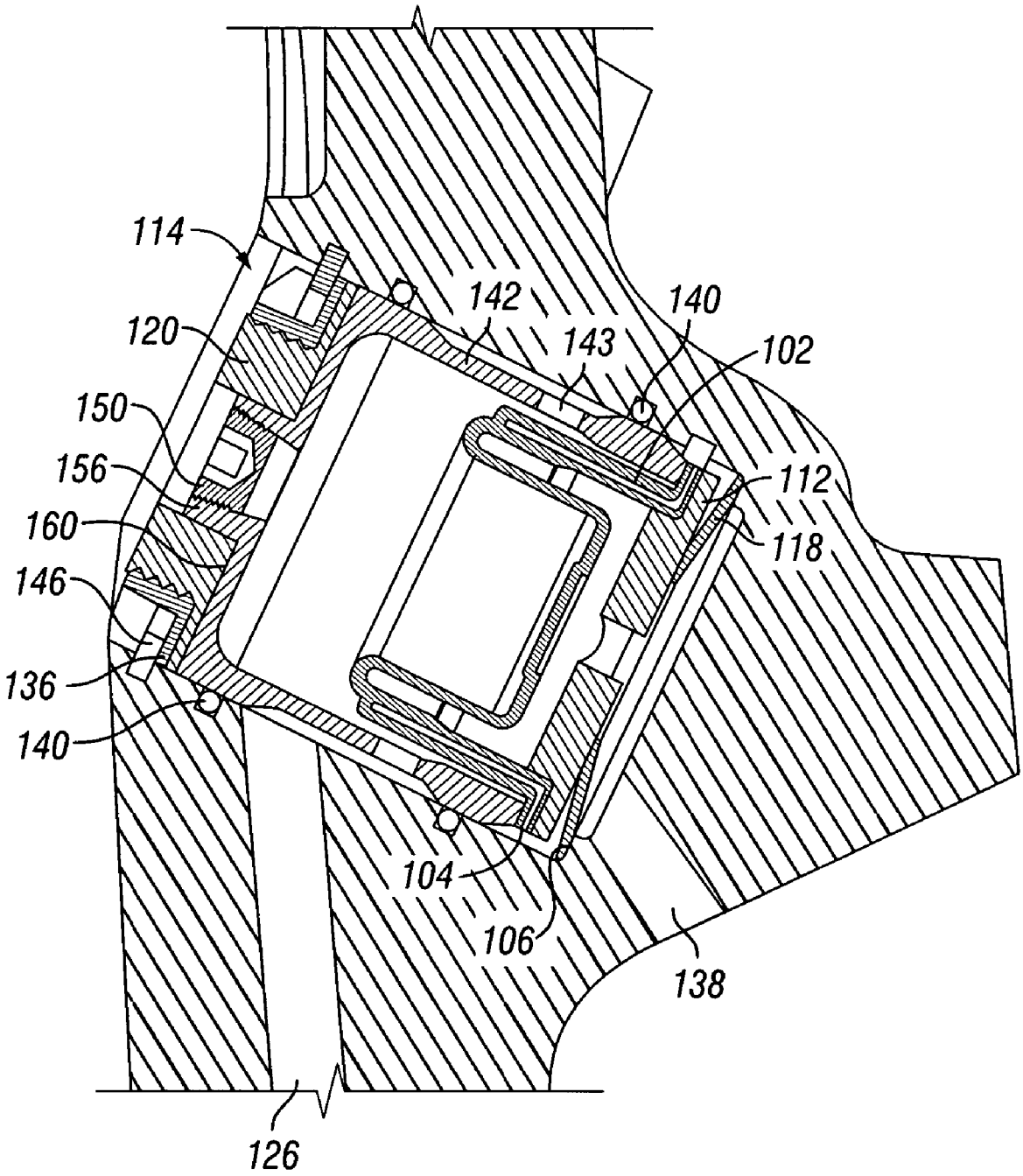
FIG. 14 shows another embodiment of a lubricant reservoir system of a rock bit having a pressure compensation assembly in accordance with aspects of the present invention.
Figure 15:
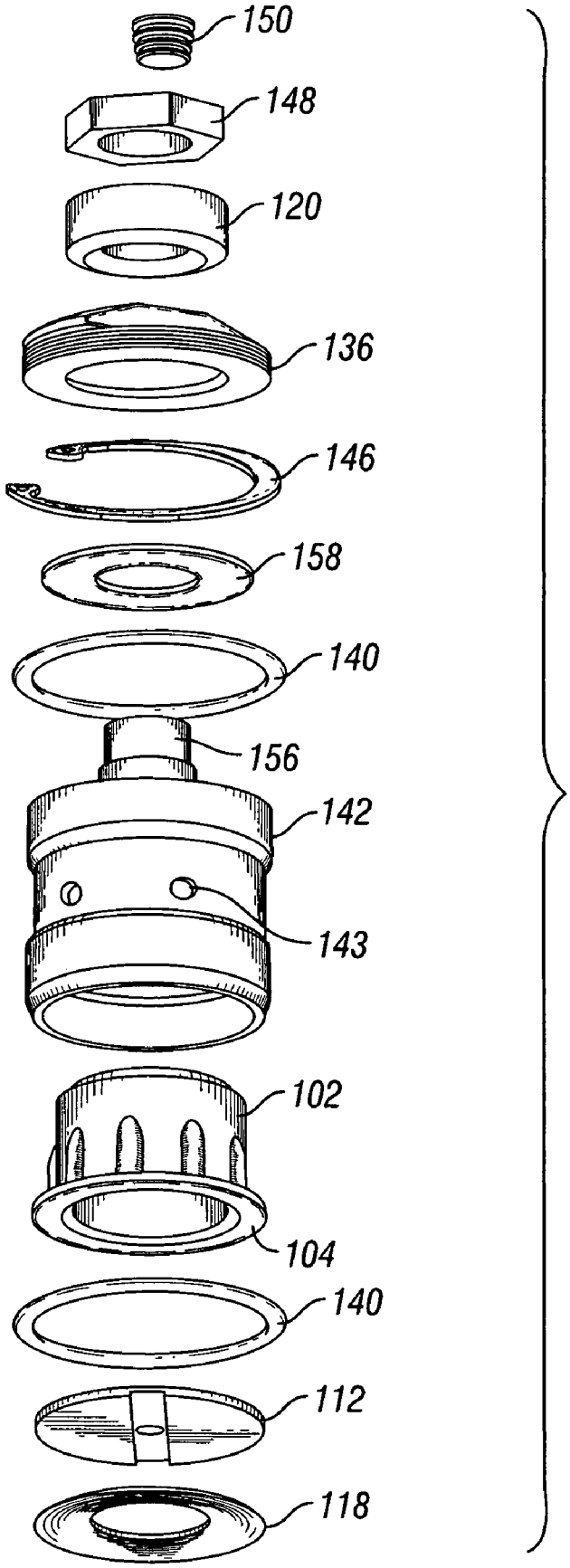
FIG. 15 shows an exploded view of the pressure compensation assembly illustrated in FIG. 14.

Now referring to another embodiment of the invention shown in FIG. 14 and FIG. 15, the lubricant reservoir system shown is configured similar to that described with reference to FIG. 4 but is adapted to permit adjustment of the relief pressure for the system in accordance with the present invention. Referring to FIG. 14, the Belleville spring 118 in this system 100 is positioned proximal the lower end of the reservoir 114 against an annular seat 106 formed therein with its inner diameter bowed upward towards the outside of the bit. An assembly comprising a reservoir boot 102 with one end extending into a canister 142 and the other end enclosed therein by a boot cap 112 is disposed in the reservoir 114 with the boot cap 112 end adjacent the Belleville spring 118. The reservoir boot 102 is held in place in the canister 142 by a flange 104 formed on its end adjacent the boot cap 112 which is sandwiched between an annular around the end of the canister 142 and an annular seat formed on the boot cap 112.

The opposite end of the canister 142 comprises a top end 160 comprising a generally flat outer surface with a boss 156 extending from a center thereof. The boss 156 includes a hole therein to permit filling of the bit with lubricant. The internal diameter of the boss 156 includes threads which are configured to mate with threads of a pipe plug 150 so that the opening in the boss 156 can be sealed after filling the bit with lubricant.

The canister is held in place in the reservoir 114 by a cover cap assembly that is configured to permit selective adjustment of the canister's position in the reservoir 114 so a bias force provided by the Belleville spring 118 can be selectively changed. Referring to FIG. 15, the cover cap assembly includes a stationary cap 136, an adjustment member 120, and a lock nut 148. The stationary cap 136 has a groove along the outer periphery for receiving a retraining ring 146 therein to lock the stationary cap 136 in place in the reservoir 114 as shown in FIG. 14. The adjustment member 120 includes threads along its outer periphery for mating with threads along the internal diameter of the stationary cap 136. The adjustment member 120 also includes a hole in a center thereof to receive the boss 156 of the canister 142 therein so that its bottom end can be seated against the top end 160 of the canister 142. The adjustment member 120 assembled with the stationary cap 136 is positioned on the top end 160 of the canister 142 with a canister shim 158 positioned between the stationary cap 136 and top end 160 of the canister 142 to control friction and facilitate relative rotation there between. The adjustment member 120 is coupled to the top end 160 of the canister 142 by the lock nut 148 shown in FIG. 15 which includes a threaded internal diameter for mating with external threads provided along a top end of the boss 156. The outer periphery of the lock nut 148 is configured such that a wrench or other tool can be used to tighten it against the adjustment member to retain the adjustment member against the top end 160 of the canister 142, and may also be used to prevent rotation of the assembly during insertion of the pipe plug 150.

Referring to FIG. 14, after assembling the canister 142 with the cover cap assembly, it is placed in the reservoir 114 as described above and retained therein by a retaining ring 146 engaged between a groove in the reservoir 114 and the groove in the stationary cap 136. A plurality of recessed holes is provided along the top surface of the adjustment member 120 so that a tool with pins can be used to adjust its position relative to the stationary cap 136 as desired. A plurality of recessed holes is also provided along the top surface of the stationary cap 136 and can be used to hold it in place to facilitate the relative rotation.

In this embodiment, the threaded coupling of the stationary cap 136 and the adjustment member 120 permits the adjustment in the system to compress the Belleville spring 118 by a desired amount for precise relief pressure control of the system. Namely, the threaded location of the adjustment member 120 in the stationary cap 136 can be adjusted to adjust the location of the canister in reservoir to thereby selectively control the amount of compression for the Belleville spring 118 sandwiched between the end of the canister 142 and the reservoir seat 106. Accordingly, the relief pressure for the system 100 can be adjusted by adjusting the location of the adjustment member 120 in the reservoir 114. Once the desired relative position is set, the stationary cap 136, adjustment member 120, lock nut 148, and canister boss 156 can be further secured together, if desired, such as by welding components together or other mechanical means to prevent further relative movement in the system.

FIGS. 9-12 show some other examples of reservoir systems for rock bits which include a canister assembly positioned in a reservoir similar to that described with reference to the example shown in FIG. 4. In these embodiments, the assemblies are modified in various ways for mounting in the reservoir and are also adapted to provide pressure compensation assemblies in accordance with aspects of the present invention.

Figure 9:
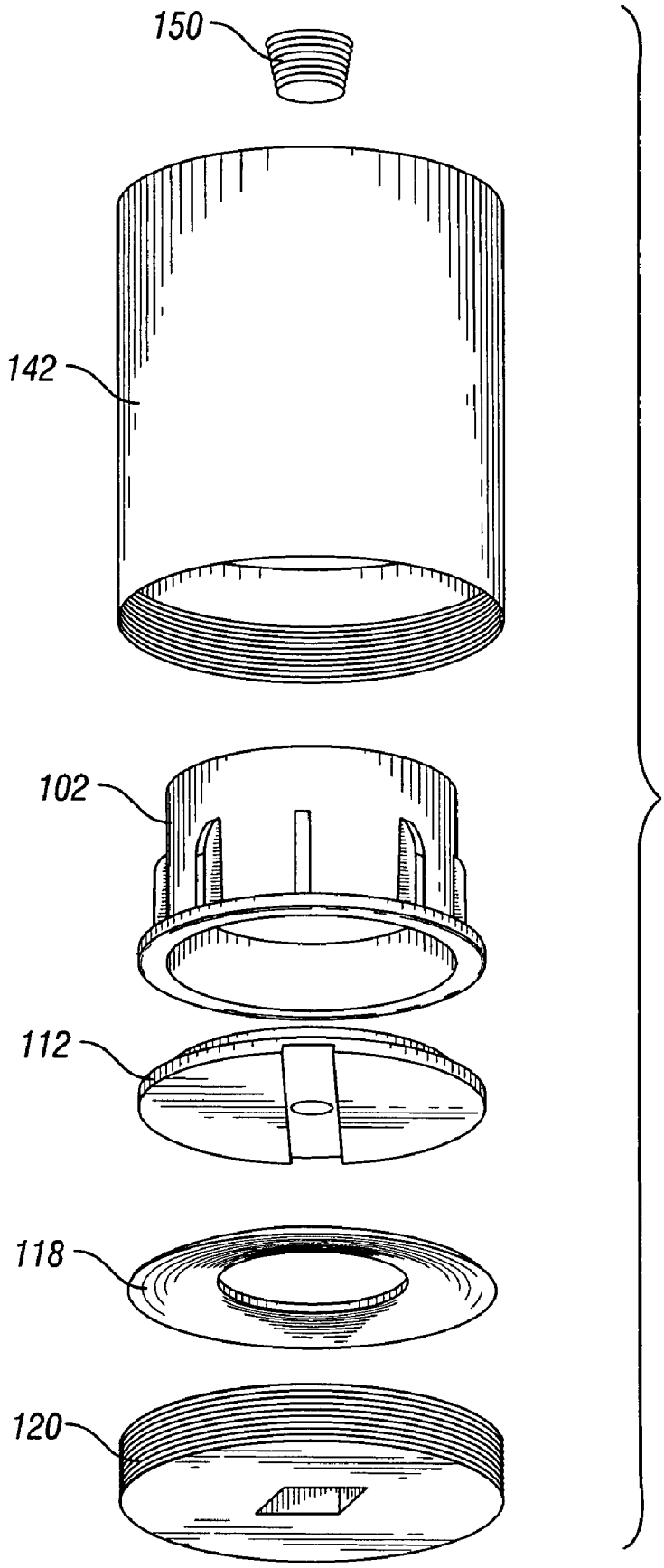
FIG. 9 shows an exploded view of another embodiment of a pressure compensation assembly for a lubricant reservoir system of a rock bit in accordance with aspects of the present invention.
Figure 10:
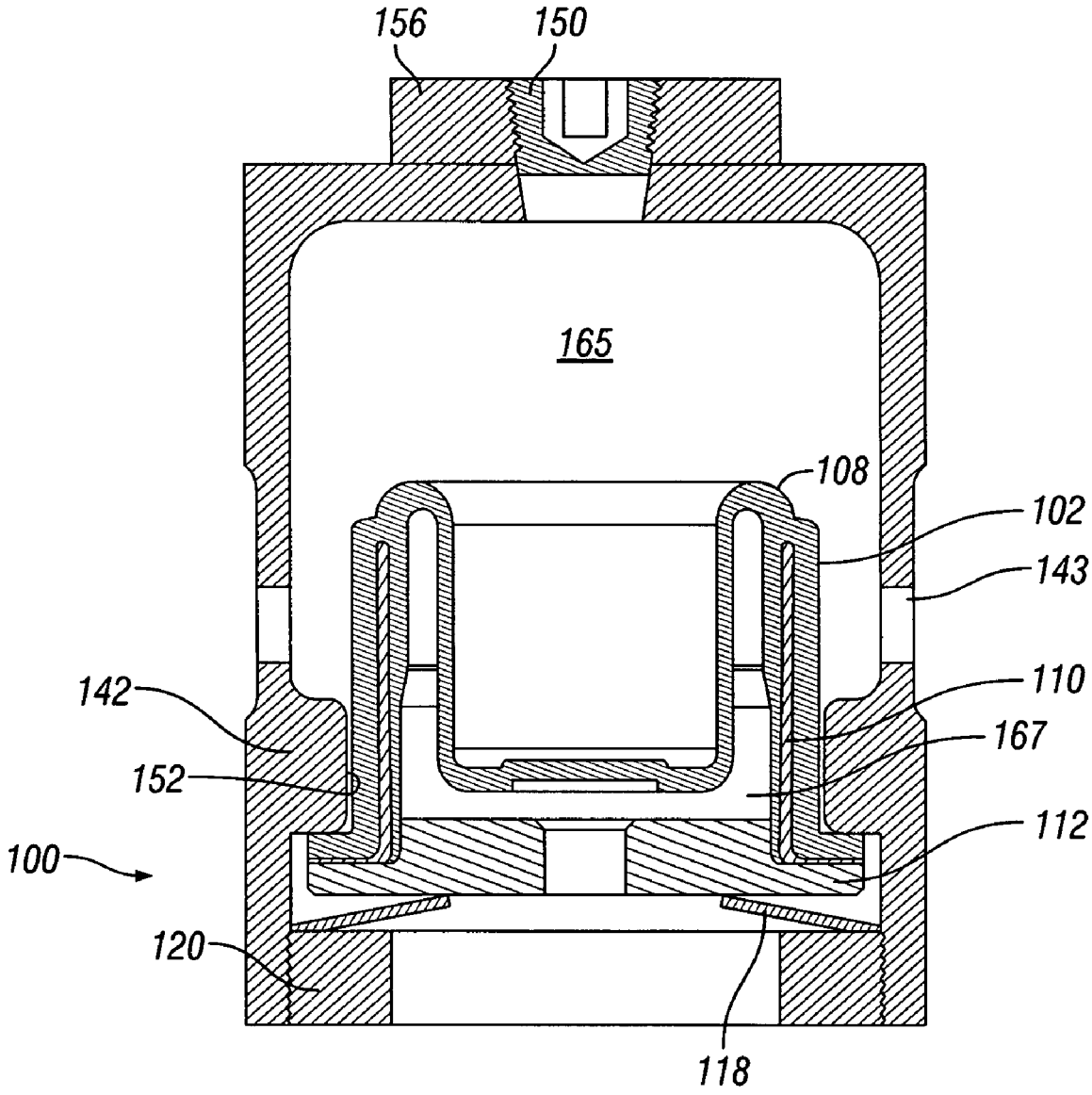
FIG. 10 shows an assembled view of a pressure compensation assembly in accordance with the embodiment illustrated in FIG. 9.

Referring to FIG. 9, in one embodiment the assembly includes a canister 142 having an opened first end for receiving a reservoir boot 102, boot cap 112, Belleville spring 118 and an adjustment member 120 therein. The internal diameter at the opened end of the canister 142 is threaded. Referring to FIG. 10, the canister 142 also includes a radial step 152 along its internal diameter axially positioned near the threaded end. The radial step 152 in the canister 142 functions as seat for locating the reservoir boot 102, boot cap 112 and Belleville spring 118. The outer diameter of the adjustment member 120 is threaded to mate with the threads at the end of the canister 142. The adjustment member 120 when installed at the end of the canister 142 functions as a seat for supporting and retaining the reservoir boot 102, boot cap 112, and Belleville spring 118 in the canister 142 against the seat of the radial step 152. The adjustment member 120 also permits adjustment of the relief pressure for the system. The wall of canister 142 includes passageways 143 formed therein to permit fluid communication between the lubricant side 165 of the reservoir boot 102 in the canister 142 and the bearings via a lubricant passageway (such as 42 in FIG. 4). The adjustment member 120, Belleville spring 118, and boot cap 112 also include passageways therein to permit fluid communication between the drilling fluid side 167 of the reservoir boot 102 and drilling fluid outside of the bit via a drilling fluid passageway (such as 67 in FIG. 4).

In this embodiment, the threaded coupling of the canister 142 and the adjustment member 120 permits the adjustment in the system to compress the Belleville spring 118 by a desired amount for precise relief pressure control of the system. Namely, the threaded location of the adjustment member 120 installed in the canister 142 relative to the seat on the radial step 152 can be adjusted to selectively control the amount of compression for the Belleville spring 118 in the system. Accordingly, the relief pressure for the system 100 can be changed by adjusting the location of the adjustment member 120 in the canister 142.

As shown in FIG. 10 and FIG. 1, the opposite end (top end) of the canister 142 is enclosed and includes a boss 156 extending from the outer surface of the end of the canister 142. A hole for filling the bit with lubricant is formed in the boss 156 and may be plugged by a pipe plug 150 adapted to engage and seal off the hole. The boss 156 at the top end of the canister is adapted, such as with flats on an outer periphery thereof, to permit coupling of a tool to transfer an applied torque. The adjustment member 120 is also adapted, such as with spaced apart holes on an outer surface thereof, to permit the coupling of a tool to transfer an applied torque. These features are provided to facilitate the selective positioning of the adjustment member 120 relative to the canister 142. Once the desired relative position is set, the adjustment member 120 can be further secured, if desired, to the canister, such as by welding or other mechanical means to prevent further relative movement.

Figure 11:
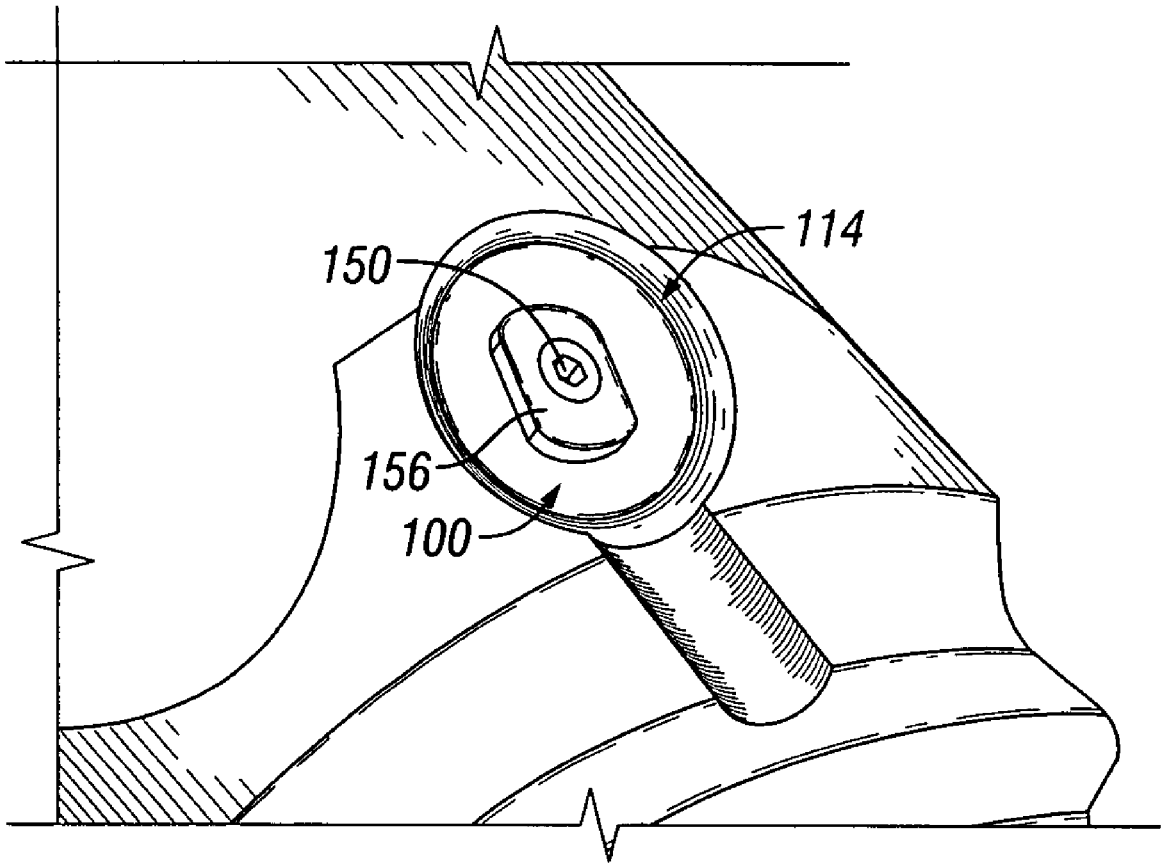
FIG. 11 shows the pressure compensation assembly illustrated in FIG. 10 installed in a lubricant reservoir of a rock bit.

Canister assemblies similar to that described shown in FIG. 9-FIG. 11 have relatively simple assembly processes. These assemblies are configured such that they can be pre-assembled and pressure tested to ensure the accuracy of relief pressures set prior to insertion in a bit. Thus, assemblies may be tested at a different location other than the assembly plant or manufacturing facility for rock bits. This can be done to save time in final assembly of rock bits and can also increase production capability, especially in cases where different relief pressures are provided in different types or sizes of bits or bits designated for different drilling application.

When the pressure compensation assembly 100 is installed in a reservoir cavity of a bit, the canister 142 functions as a housing for the system components as well as a housing for lubricant provided to the reservoir. With this configuration the canister 142 may be press fit, if desired, into a reservoir cavity formed in the bit body to eliminate the need for components such as seals and a retainer ring as shown in FIG. 4. However, in other embodiments, such as those shown in FIG. 12-FIG. 15, the canister may be adapted for mounting the assembly in a bit reservoir with o-ring seals 140 and a retainer ring 146 similar to that shown and described above with reference to FIG. 4.

Figure 12:
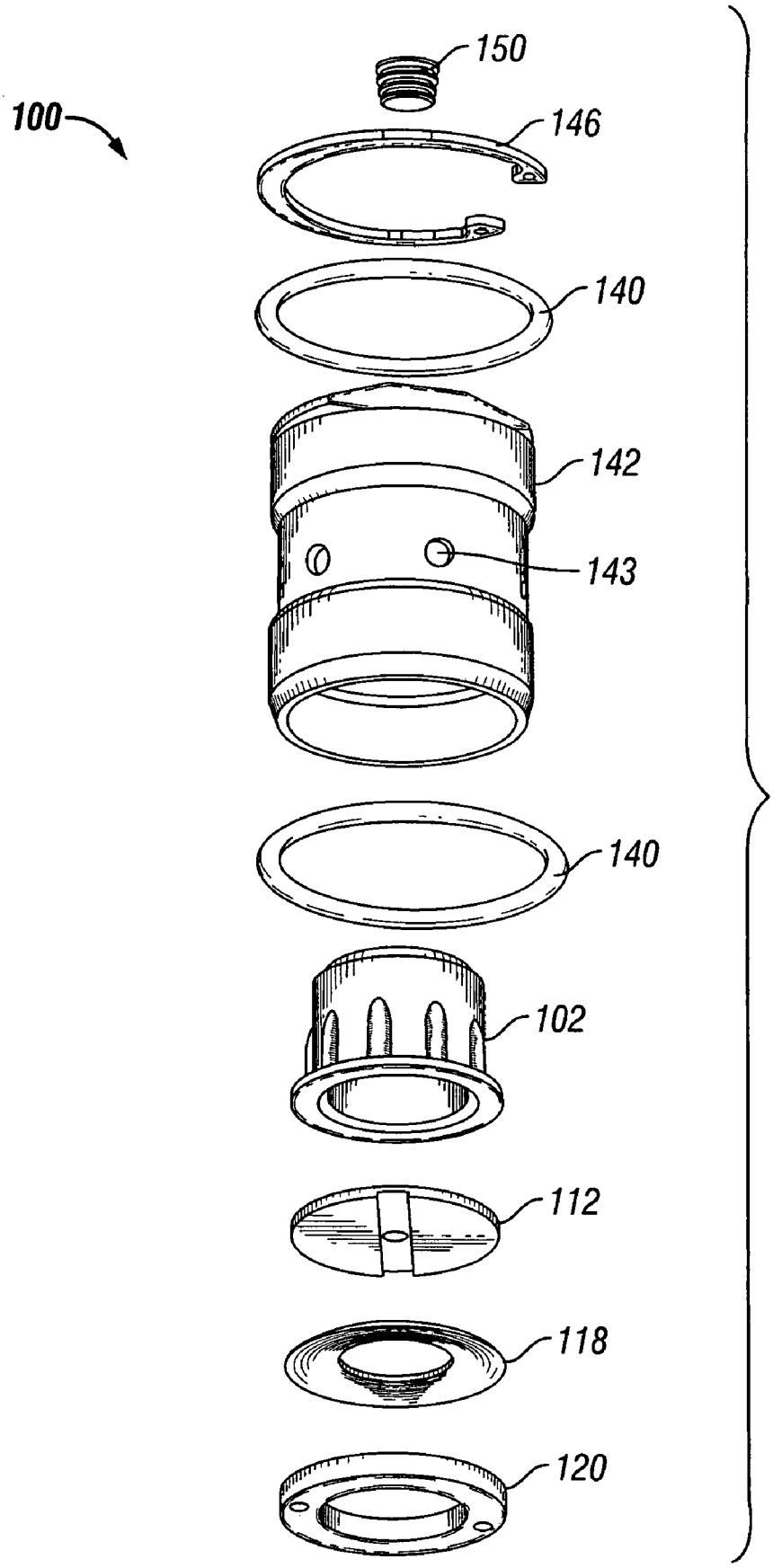
FIG. 12 shows another embodiment of a pressure compensation assembly for a lubricant reservoir system of a rock bit in accordance with aspects of the present invention.
Figure 13:
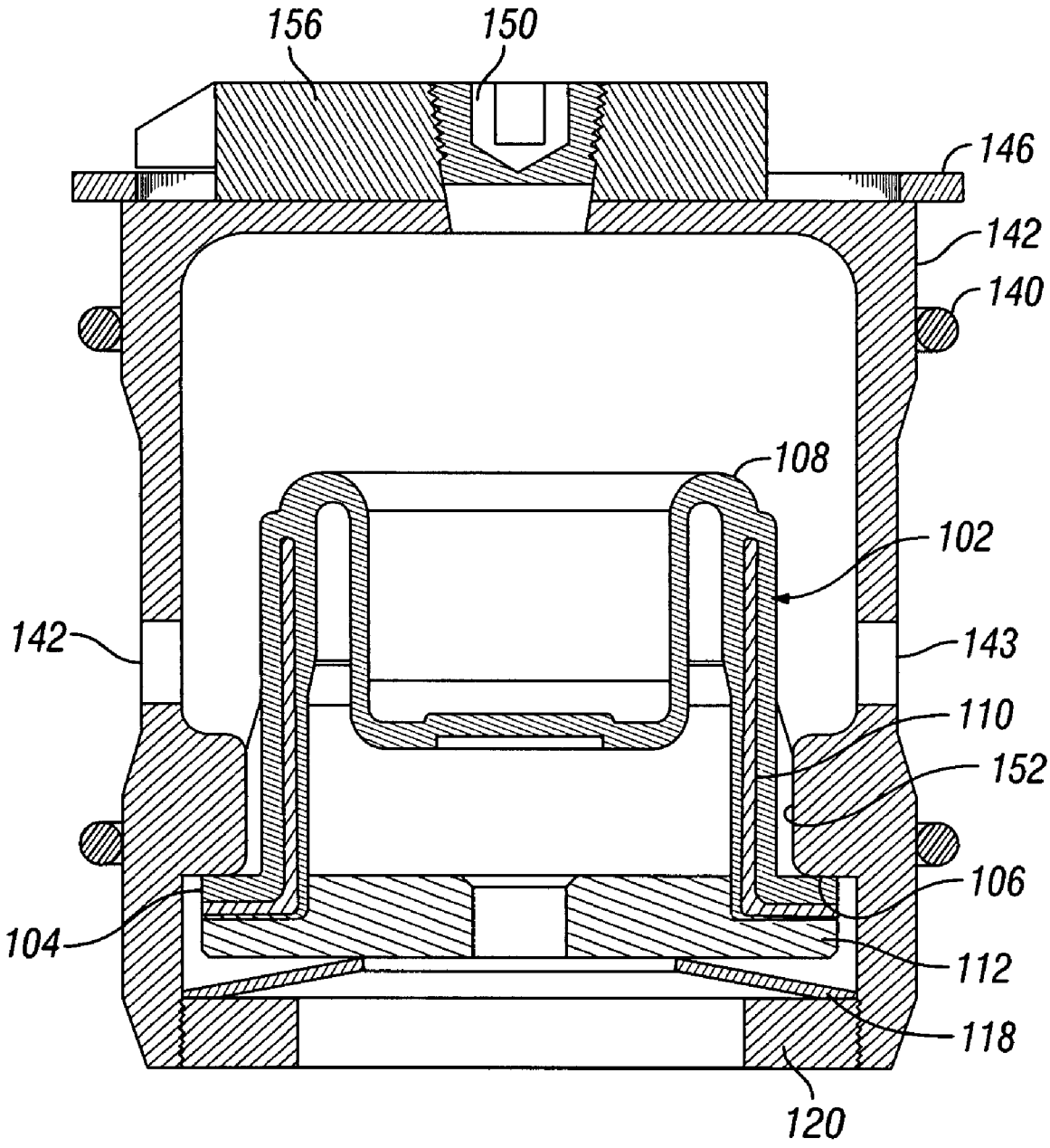
FIG. 13 shows an assembled view of the pressure compensation assembly illustrated in FIG. 12.

For the embodiment illustrated in FIG. 12 and FIG. 13, the system is configured similarly to that described above with reference to FIG. 9-FIG. 11 in that the canister 142 is opened first at a first end for receiving the reservoir boot 102, boot cap 112, and Belleville spring 118 with threads therein for mating with corresponding threads on a periphery of the adjustment member 120. The adjustment member 120 functions as a seat for supporting the reservoir boot 102, boot cap 112, and Belleville spring 118 in the canister 142 against an annular seat on radial step 152 and also permits adjustment of the relief pressure for the system in a manner similar to that described above with reference to FIG. 9-FIG. 11. However in the embodiment shown in FIGS. 12 and 13, the top end of the canister is configured similar to that shown in FIG. 4, wherein the system is installed and retained in the a reservoir by a retaining ring 146 engaged between a grove formed around the top end of the canister 142 and a groove formed in the wall of the reservoir (not shown). Additionally, o-ring seals disposed in grooves formed in the wall of the reservoir (not shown) provide sealing engagement above and below lubricant inlets into the canister to isolate the flow of lubricant in the reservoir from drilling fluid. A hole provided in the upper end of the canister 142 can be used for filling the bit with lubricant and then plugged by a pipe plug 150 adapted to engage and seal off the hole. As shown in FIG. 12, the top end of the canister 142 includes flats and the adjustment member 120 coupled to the canister includes holes that can be used to facilitate selective positioning of the adjustment member 120 in the canister 142 to achieve a desired bias force for the system. The adjustment member 120 can then be fixed to the canister, such as by welding or other mechanical means, to prevent further relative movement of the adjustment member 120 in the system.

In view of the above description, those skilled in the art will appreciate that the principles of the present invention illustrated above can be adapted and used for any pressure compensation assembly having a bias member that effects the relief pressure set point for the system. Thus, with the same parts of any given lubricant reservoir system, the system can be modified to include adjustment members that permit selective adjustment of the bias provided by the bias member in the system so that the relief pressure for the system can be adjusted to a desired value to meet the needs of an application.

Rock bits having reservoirs with controllable relief pressures in accordance with the present invention may permit the selective setting of relief pressures as desired for different application. For example, bits having two or more legs/cones with a different lubricant reservoir system supplying lubricant to each leg may include an adjustable relief system to ensure that the legs of the bit are provided with the same relief pressures despite manufacturing errors or tolerances. This can be done to reduce the risk of a premature seal failure in one of the legs. Alternatively, the relief pressures may be adjusted as desired to provide a bit having legs with different relief pressures. This may be desired for example in the case of a bit having different sized cones or different seals for each leg.

Figure 16A:
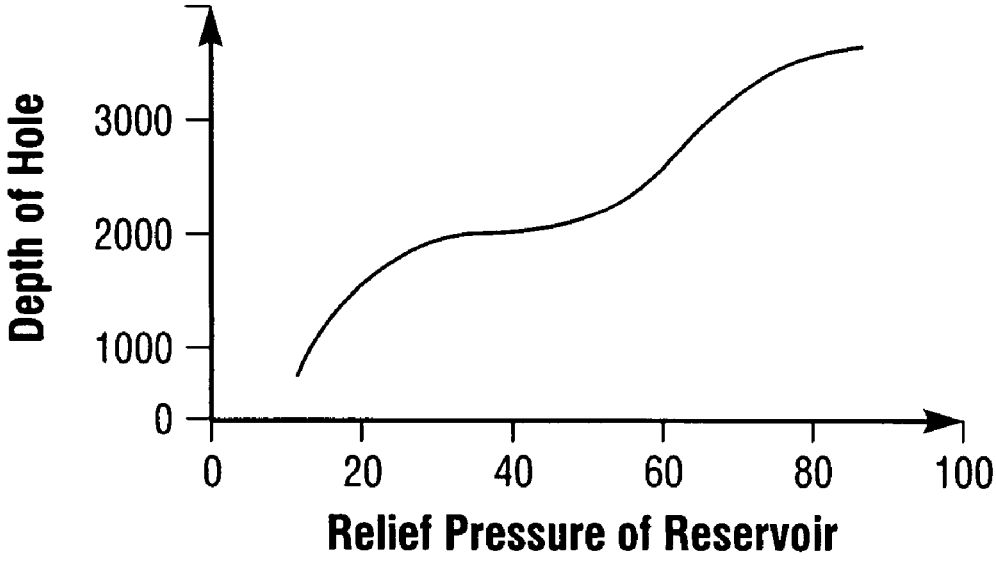
FIGS. 16A-D show examples of relationships that may be established and used to determine desired relief pressure values for a reservoir system based on bit design or drilling application parameters.
Figure 16B:
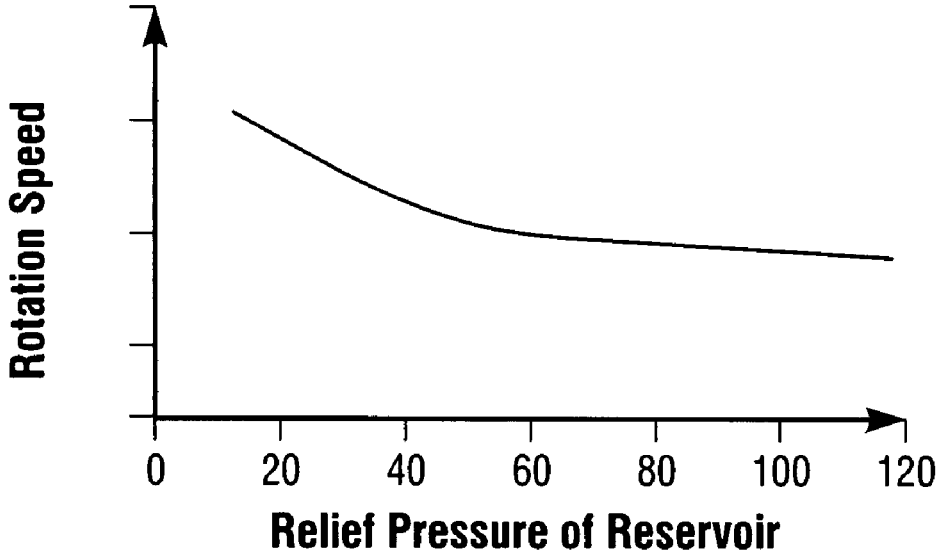

Also with embodiments of the present invention, the same pressure relief structure may be used in a plurality of bits designated for different drilling applications and the reservoir relief pressures adjusted as desired based on a drilling application parameter, such as the hardness of the rock formation to be drilled, the section depth of a hole to be drilled, the rotation speed of a drill string, the weight on a bit, the geographic location of drilling, or the a bottom hole assembly to be used. FIG. 16A shows one example of a relationship may be established and used to determine the desired relief pressure for bits based on the depth of a hole section to be drilled. FIG. 16B shows one example of a relationship may be established and used to select the desired relief pressure for bits based on a rotation speed to be used for drilling.

Figure 16C:
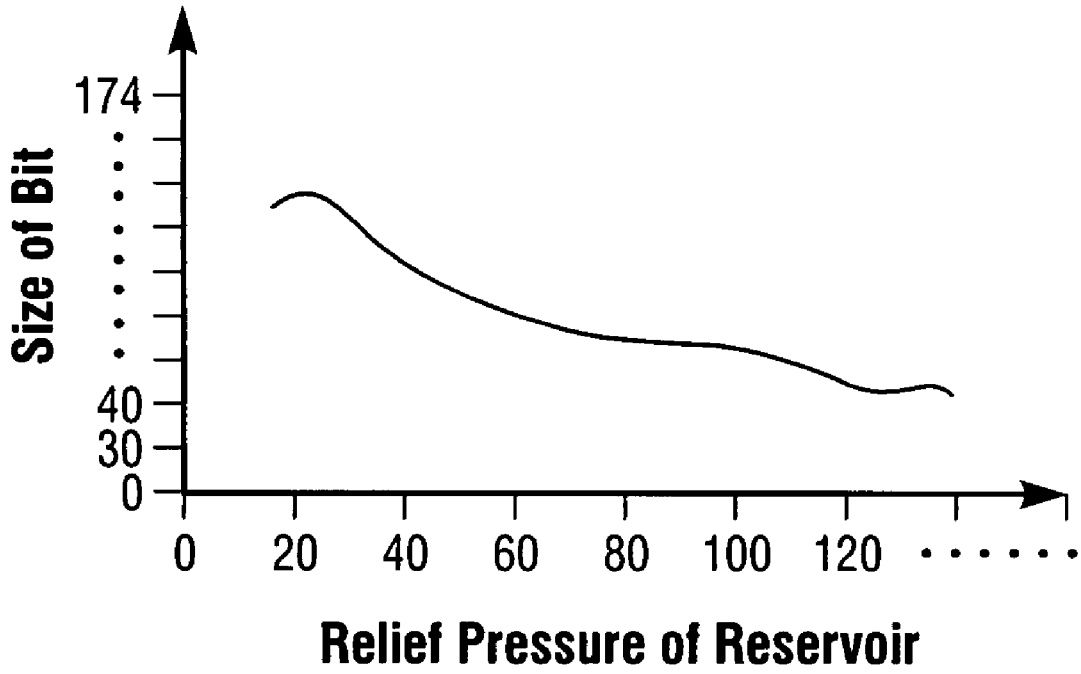
Figure 16D:
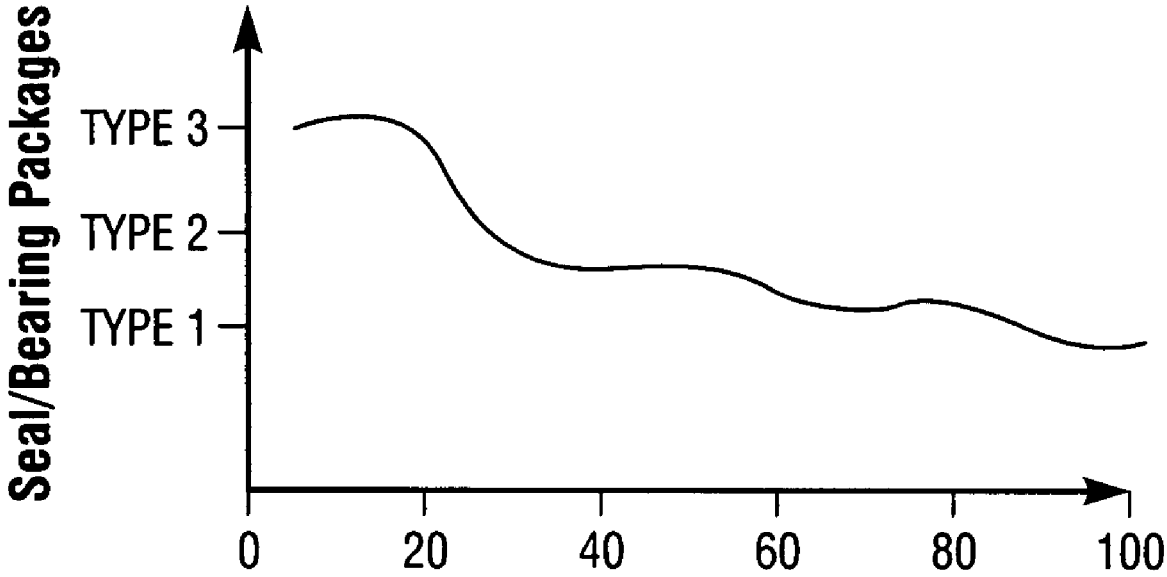

Additionally, with embodiments of the present invention, the same pressure relief structure may be used in different sized bits or in different types of bits and the relief pressures set for each of the bits based on the size or type of bit. FIG. 16C shows one example of a relationship that may be established used to set desired relief pressures for bits based on the bit size. FIG. 16D shows one example of a relationship that may be established used to set desired relief pressures for lubricant reservoir systems based on the seal/bearing package being used. Numerous other relationships may be established based on bit design or bit application parameters as desired.

Different approaches can also be used to determine or measure the relief pressure of a reservoir system. For example, a torque wrench can be used to establish a relation between the torque readings and relief pressures. The information can then be used to determine for any given value of torque the corresponding relief pressure. In another case, a pre-setup pressure measured by a gas meter can be used to control relief pressure. First the Belleville spring is stressed to a value. Then, gas (e.g. nitrogen) is pressed into the reservoir system to check the relief pressure. Then, the supporting load of the Belleville spring is adjusted to such a value that the relief pressure is exactly consistent with the desired value.

Numerous other configurations for lubricant reservoir systems exist and, thus, the examples shown and described above are not considered limiting on the present invention. For example, other lubricant reservoir systems may include any number of reservoirs disposed anywhere in a bit and adapted to supply lubricant to the bearings of one or more legs, as described for example in U.S. Pat. No. 6,619,412, incorporated herein by reference. Similarly, many different types of pressure compensation assemblies exist. Accordingly, the inclusion or non-use of particular reservoir system components in the reservoir is not considered to be limiting on the present invention. Also, while the description of example embodiments of the invention has been made, in part, with respect to a single reservoir, those skilled in the art will appreciate that it may be applied equally to each reservoir of a multiple reservoir leg or drill bit. Additionally, although drill bits are the primary application described above, the disclosed invention can also be applied to other rock-penetrating tools, such as reamers, coring tools, and other rotary drilling applications.

Thus, while the invention has been described with respect to a limited number of examples, those skilled in the art, having benefit of this disclosure, will appreciate that other embodiments can be devised which do not depart from the scope of the invention. Accordingly, the scope of the invention should be limited only by the attached claims.

What is claimed is:

1. A rotary rock bit comprising;

a lubricant reservoir disposed in a bit body and communicating with a bearing area formed between a rolling cutter and a journal pin, a pressure compensation assembly disposed within said reservoir, said pressure compensation assembly comprising:

a flexible diaphragm separating the reservoir into a lubricant region and a drilling fluid region and including a valve face; and a bias member compressed between an adjustment member and a second member in the reservoir to bias the valve face of said diaphragm against a valve seat disposed in the reservoir to prevent flow of lubricant from within said reservoir to the exterior thereof until lubricant pressure exceeds a set value, said adjustment member in contact with said bias member and adapted to permit adjustment of its position relative to said second member such that the compression of the bias member provided in the assembly can be selectively adjusted.

2. The rotary rock bit of claim 1, wherein the adjustment member comprises a threaded outer periphery configured to engage an inner wall of the lubricant reservoir.

3. The rotary rock bit of claim 1, wherein the adjustment member comprises at least one fluid passageway disposed therethrough.

4. The rotary rock bit of claim 1, further comprising a fill passage in fluid communication with the lubricant reservoir.

5. The rotary rock bit of claim 1, further comprising a tool connector coupled to the adjustment tool.

6. The rotary rock bit of claim 1, wherein the second member comprises at least one fluid passageway disposed therethrough.

7. The rotary rock bit of claim 1, further comprising a stationary member configured to receive an upper portion of the adjustment member.

8. The rotary rock bit of claim 7, wherein the upper portion of the adjustment member is threadedly engaged with the stationary member.

9. A rotary rock bit comprising a lubricant reservoir disposed in a bit body communicating with a bearing area formed between a rolling cutter and a journal pin, a pressure compensation assembly disposed within said reservoir, said pressure compensation assembly comprising:

a flexible diaphragm separating the reservoir into a lubricant region and a drilling fluid region; and a pressure relief assembly comprising a bias member positioned in said assembly to bias a valve face against a valve seat to prevent flow of lubricant from within said reservoir to the exterior thereof until excess lubricant pressure exceeds a set value; the pressure relief assembly further comprising an adjustment member in contact with said bias member and adapted such that its location within said reservoir can be adjusted to permit selective adjustment of the bias provided by the bias member in the assembly.

10. The rock bit of claim 9, wherein said bias member comprises a Belleville spring.

11. The rotary rock bit of claim 9, wherein the bias member is disposed proximate a lower end of the reservoir.

12. The rotary rock bit of claim 11, further comprising a canister disposed above the bias member, wherein the canister comprises at least one opening in an upper end.

13. The rotary rock bit of claim 12, further comprising a plug configured to seal the at least one opening in the upper end of the canister.

14. The rotary rock bit of claim 12, further comprising a stationary member and a lock ring disposed above the canister, wherein the lock ring is configured to secure the stationary member in the reservoir.

15. The rotary rock bit of claim 14, wherein the adjustment member is threadedly engaged with the stationary member.

16. The rotary rock bit of claim 12, further comprising at least one sealing element disposed on an outer periphery of the canister.

17. The rotary rock bit of claim 9, wherein the adjustment member comprises at least one recessed hole on a top surface.

18. The rotary rock bit of claim 12, wherein the canister further comprises at least one fluid passageway formed in a wall of the canister.

* * * * *

UNITED STATES PATENT AND TRADEMARK OFFICE

CERTIFICATE OF CORRECTION

PATENT NO. : 7,665,547 B2
APPLICATION NO. : 11/601029
DATED : February 23, 2010
INVENTOR(S) : Yong et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 341 days.

Signed and Sealed this

Twenty-eighth Day of December, 2010

David J. Kappos

David J. Kappos
*Director of the United States Patent and Trademark Office*